United States Patent [19]

Heymann et al.

[11] Patent Number: 4,527,707

[45] Date of Patent: Jul. 9, 1985

[54] DEVICES FOR SECURING A DEBRIS HOLDING TRAY TO A GLASS OR DISH RACK

[76] Inventors: Mark S. Heymann, 1777 N. California, Suite 330, Walnut Creek, Calif. 94596; Steven Bachenheimer, 415 Foxdale La., Arlington Heights, Ill. 60004

[21] Appl. No.: 600,387

[22] Filed: Apr. 16, 1984

[51] Int. Cl.[3] ..... B65D 11/10

[52] U.S. Cl. ..... 220/1 R; 220/19; 220/69; 220/1 C; 211/71; 211/126; 211/74

[58] Field of Search ..... 220/1 R, 1.5, 19, 4 A, 220/4 F, 69, 211, 324, 325, 326, 1 C; 211/71, 126, 74

[56] References Cited

U.S. PATENT DOCUMENTS

| | | | |
|---|---|---|---|
| 519,736 | 5/1894 | Reid . | |
| 542,912 | 7/1895 | Wood . | |
| 934,721 | 9/1909 | Garretson . | |
| 1,023,982 | 4/1912 | Barnes | 220/69 X |
| 1,088,642 | 2/1914 | Wilcox . | |
| 1,279,033 | 9/1918 | Stollberg | 220/19 X |
| 1,407,066 | 2/1922 | Johnson | 220/69 |
| 1,569,157 | 1/1926 | Thompson . | |
| 1,904,969 | 4/1933 | Cavano et al. . | |
| 1,985,808 | 12/1934 | Lasell . | |
| 2,213,918 | 9/1940 | Lofstrand, Jr. . | |
| 2,539,024 | 1/1951 | Leiby . | |
| 2,550,355 | 4/1951 | James . | |
| 2,646,809 | 7/1953 | Van Hise . | |
| 2,741,392 | 4/1956 | Weiss . | |
| 2,743,029 | 4/1956 | Mautner . | |
| 2,768,022 | 10/1956 | Pope . | |
| 2,799,426 | 7/1957 | Kaye | 220/19 |
| 3,009,579 | 11/1961 | Ettlinger, Jr. . | |
| 3,179,277 | 4/1965 | Olson et al. | 220/69 X |
| 3,203,557 | 8/1965 | Ettlinger, Jr. . | |
| 3,217,890 | 11/1965 | Maslow . | |
| 3,333,722 | 8/1967 | Panknin | 220/19 X |
| 3,348,723 | 10/1967 | Wilson | 220/19 X |
| 3,433,357 | 3/1969 | Nolte . | |
| 3,811,747 | 5/1974 | Levin . | |
| 3,954,293 | 5/1976 | Orr . | |

OTHER PUBLICATIONS

Brochure relating to Adjustable Draw Latches; Southco, Inc.; not dated.

*Primary Examiner*—Steven M. Pollard
*Attorney, Agent, or Firm*—Parkhurst & Oliff

[57] ABSTRACT

The invention relates to various embodiments of a device for securing a glass or dish rack to a debris holding tray for collecting waste fluid and debris from glasses, cups or dishes prior to washing in an automatic dishwasher.

22 Claims, 20 Drawing Figures

FIG. 9
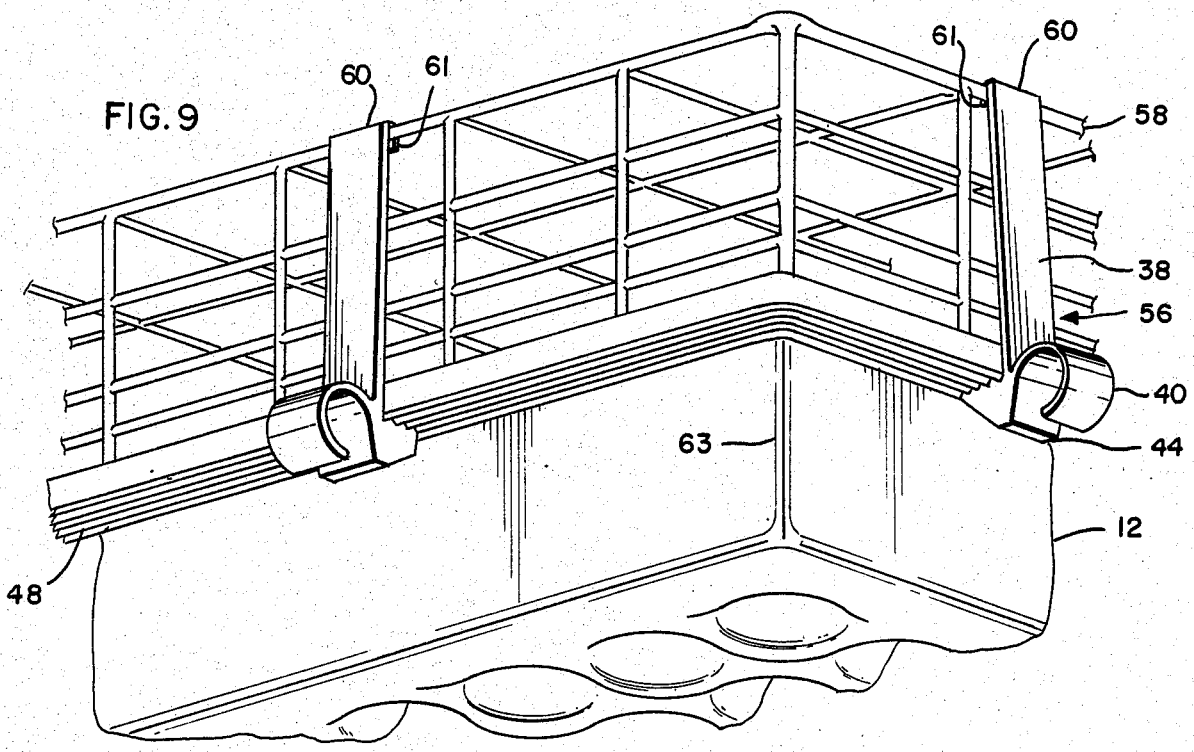
FIG. 10
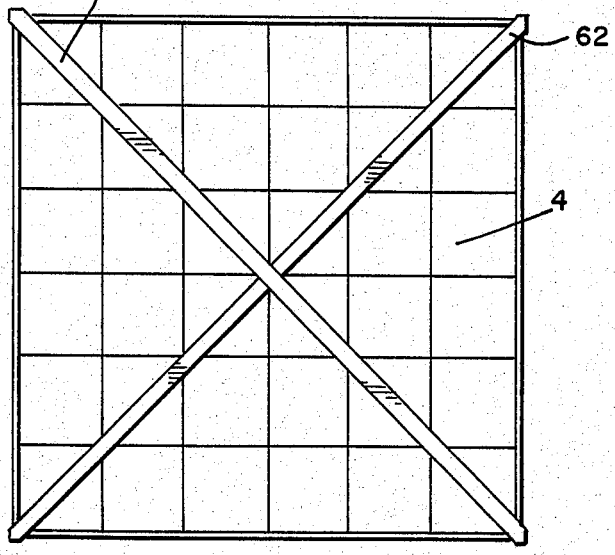
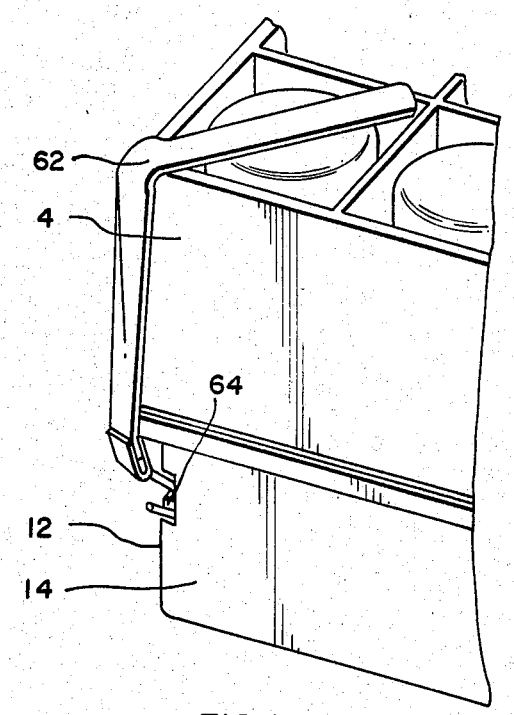
FIG. 11

FIG. 12
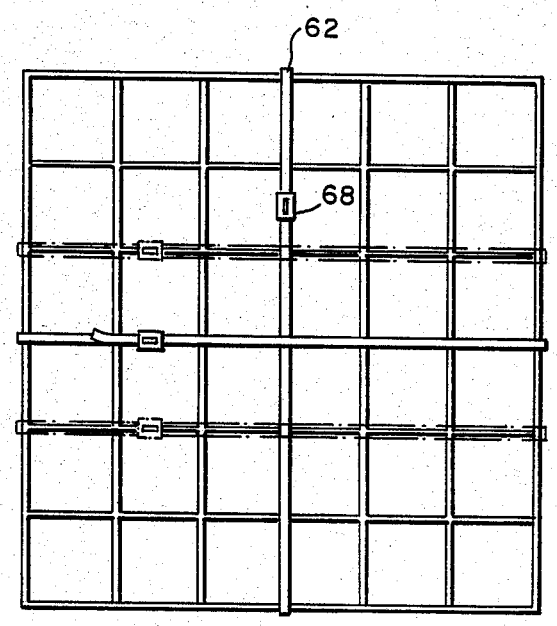
FIG. 13
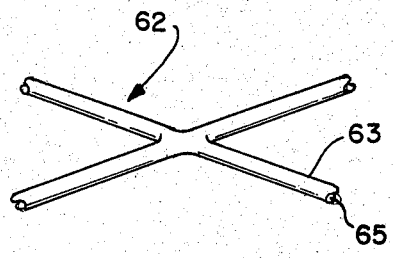
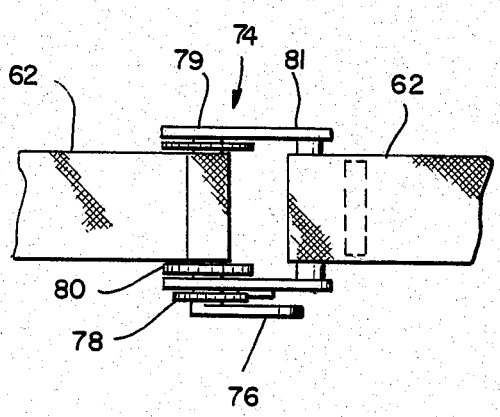
FIG. 15
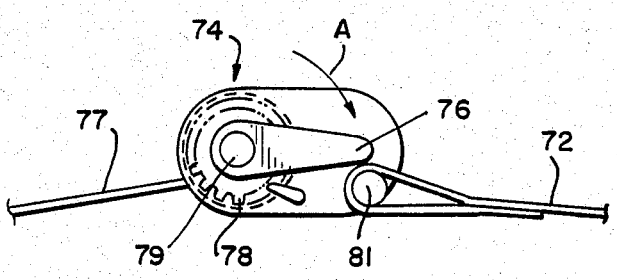
FIG. 16

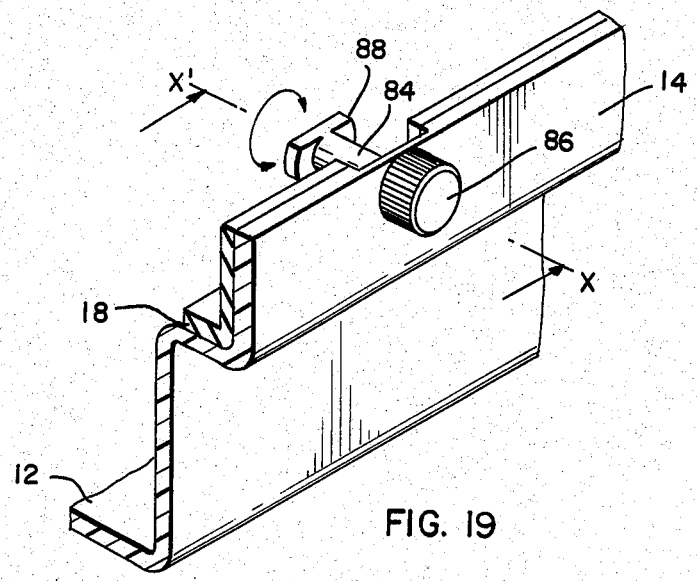
FIG. 19
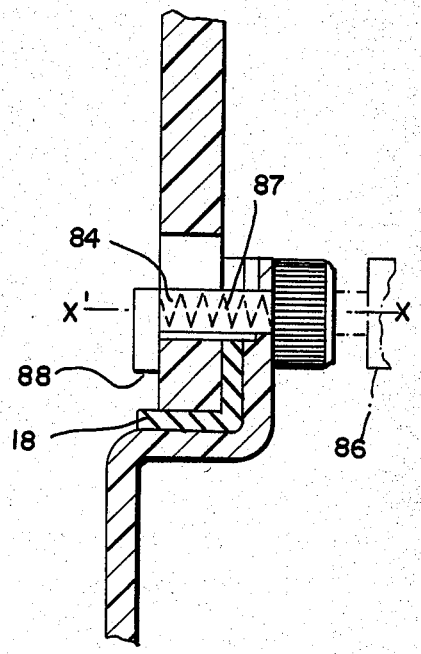
FIG. 20
FIG. 14
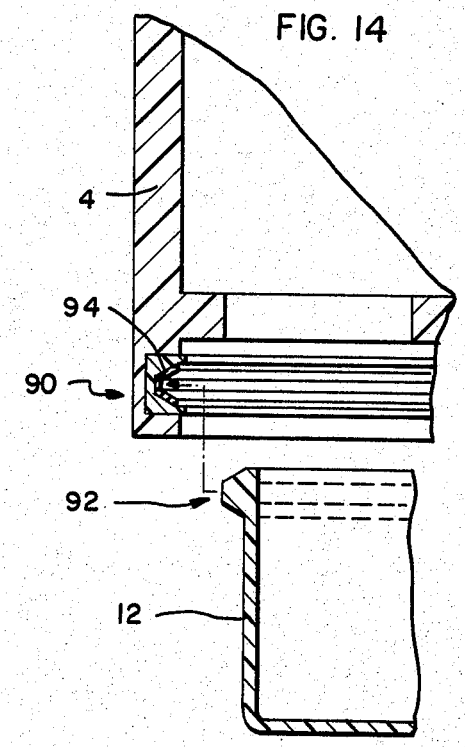
FIG. 17
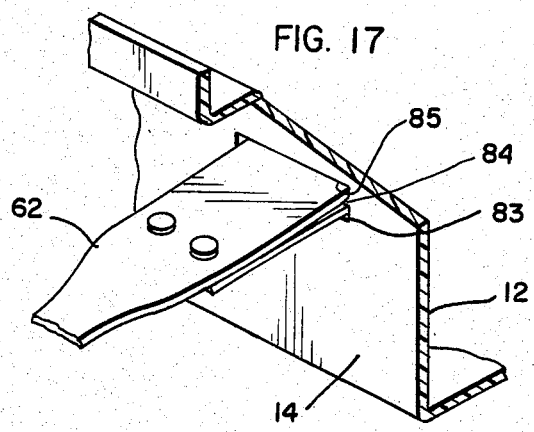
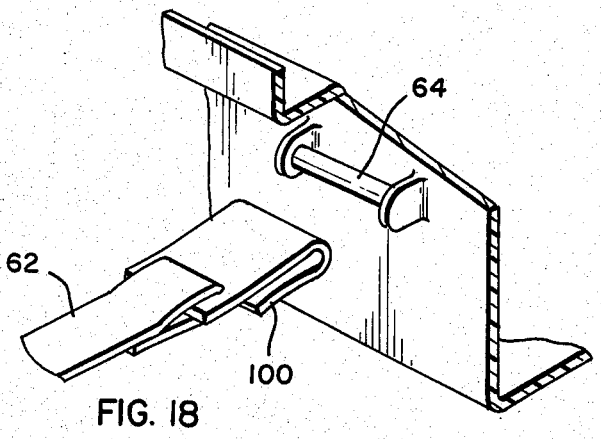
FIG. 18

DEVICES FOR SECURING A DEBRIS HOLDING TRAY TO A GLASS OR DISH RACK

BACKGROUND AND SUMMARY OF THE INVENTION

The invention relates to a device for releasably securing a substantially rectangular debris holding tray to a glass or dish rack, wherein the debris holding tray has four substantially vertical side walls and a bottom made from temperature resistant, impact resistant rubberized materials. The bottom may be smooth or ribbed to prevent wave motion.

Restaurants have needed an efficient, preferably one-step, method for removing dirty glasses, cups, silverware, pots or dishes from the dining area and inserting the glasses or dishes in an automatic industrial dishwasher. This invention provides a mechanism for attaching a debris holding tray to a conventional glass or dish rack that allows secure attachment of the tray to the glass or dish rack, and in some embodiments, also provides a mechanism for carrying the tray with the rack disposed over the tray.

It is an object of the present invention to provide a plurality of easily detachable devices for securing a debris holding tray to a conventional glass, dish, silverware, or pot rack for a dishwasher. The devices for attaching the debris holding tray to the rack are preferably impact resistant, and easily replaceable.

Another object of the present invention is to provide a device for attaching a debris holding tray to a glass or dish rack which can be placed around the rack and tray at a plurality of positions.

Still another object of the present invention is to provide a device for both securing a debris holding tray to a glass or dish rack and for carrying the debris holding tray with the glass or dish rack disposed over the debris holding tray.

Yet another object of the present invention is to provide an inexpensive device of simple construction with a minimum number of parts for securing a glass or dish rack to a debris holding tray.

In one embodiment of the invention, the device has a resilient member connected to and extending from the debris holding tray. The resilient member is preferably disposed on a side wall of the debris holding tray. The resilient member has a dog, or projection, for engaging the glass, dish, silverware or pot rack. The dog has a first latch face for selectively engaging a side of the rack. Alternatively, the dog includes a first latch face and a second latch face for selectively receiving a portion of a pole for disengaging the rack from the tray. The pole can be fastened or fixed to a frame over which the entire tray can be placed. A plurality of resilient members can be used to secure the tray to the rack. Similarly, a plurality of poles can be used for disengaging the rack from the tray.

Once the first latch face of the resilient member is engaged with the glass rack, the debris holding tray can be quickly and easily disengaged from the rack by sliding the resilient member of the debris holding tray over the vertical pole. The vertical pole engages with the second latch face of the resilient member, and, as the tray is pushed downward, the resilient member is pushed downward over the pole. The first latch face of the resilient member is pulled away from engagement with the rack as a result of engagement with the vertical pole. Once the resilient member is disengaged from the rack, the rack can be easily separated from the tray and lifted off the tray for placement in a dishwasher.

The resilient member of the above-identified embodiment may be non-integral or integral with the debris holding tray. Further, the resilient member may be adjustable in length so that it may attach to any size glass rack. The resilient member may extend from the tray and fasten over the top of the rack or alternatively, fasten in another aperture in the side of the rack. The aperture can serve as a handle for the rack and can be centrally disposed in the side wall of the rack.

In another embodiment, the device may have at least two resilient members integral with and extending from opposite side walls of the debris holding tray. In this embodiment, the resilient members each have a dog or projection for engaging the glass or dish rack. The dog or projection comprises a first latch face with means for engaging a side of the glass or dish rack. The dog also comprises a handle portion. The handle portion provides means for disengaging the dog from the glass or dish rack. Additionally, the handle portion may provide means for carrying the debris holding tray while the glass or dish rack is disposed over the liquid holding tray, but it is not requisite that the handle portion perform both tasks. The resilient members of this embodiment may be integral or alternatively, non-integral with the debris holding tray, so that the members can be adjustable, in order to correspond to different sizes of conventional glass or dish racks.

Another embodiment of the present invention relates to a detachable device for releasably securing a debris holding tray to a glass or dish rack, wherein the tray comprises four substantially vertical side walls with an outwardly extending lip disposed around the perimeter of the side walls. The side walls and bottom are made of temperature resistant, impact resistant rubberized material and the bottom further has a corrugated construction. The device includes a clip which has a handle portion preferably integral with a body portion. The body portion of the clip has a substantially C-shape. A top member of the body portion has a first latch face and means for fitting against a portion of the glass or dish rack, preferably the top of the glass rack. A side member of the body portion extends from the top member to a bottom member of the clip. The bottom member has a second latch face for fitting against the lip portion of the debris holding tray. The handle portion of the clip extends outwardly from the body portion of the clip, in a direction opposite from the debris holding tray. The handle portion can be used to carry the debris holding tray with a glass or dish rack disposed on top of the debris holding tray. Alternatively, the handle portion can be used simply as a release mechanism for detaching the attaching means of the tray from the rack.

In yet another embodiment, the invention relates to a device for releasably securing a debris holding tray to a glass or dish rack. The tray has four substantially vertical side walls, with an outwardly extending lip disposed around the perimeter of the side walls, and a bottom. The bottom may be smooth, or alternatively, corrugated to prevent wave motion when the debris holding tray contains liquid. The device of this embodiment includes a clip made from resilient material with a handle portion. The handle portion is connected to an L-shaped body portion and can be integral or non-integral with the body portion. The body portion has a side member for removably securing the side member to the glass or dish rack, for instance, by a bolt assembly. The clip has a bottom member with a latch face for fitting against a portion of the debris holding tray. The handle portion of the clip permits carrying of the debris holding tray with the glass or dish rack disposed on top of the debris holding tray.

In yet another embodiment of the invention, the detachable device comprises an elongated attaching means for securing the glass or dish rack to the debris holding tray. This attaching means has at least two members wherein a first member is secured at one end to a first vertical side wall of the tray and a second member is secured at one end to a second vertical side wall opposite the first vertical side wall of the tray. The nonsecured ends of the first and second members of the attaching means can then be secured together around the rack, thereby fastening the rack securely to the tray. The length of the attaching means can be adjusted to compensate for different sizes of racks. The attaching means of this embodiment may be flexible or alternatively, have a rigid character.

A further embodiment of the instant invention involves a device for securing the glass or dish rack to the debris holding tray with a shaft. The shaft may be spring-loaded and disposed within an upper portion of a side wall of the debris holding tray. A knob is disposed at one end of the shaft and a securing member is disposed at the other end of the shaft. The securing member can rotate about the longitudinal axis of the shaft, particularly between two diametrically opposed positions. At one position, the securing member engages the glass or dish rack and fastens the rack to the tray. At a second position diametrically opposite from the first position, the member is not engaged with the rack so that the rack can be easily lifted off the tray. In operation, the debris holding tray is disposed with the securing member of the device located within the interior side walls of the tray and disposed flush against the walls. The glass or dish rack can then be placed over the tray and the device pushed so as to engage with the wall of the glass or dish rack. The knob on the device can then be rotated, so that the securing member engages the rack.

Another embodiment of the present invention involves a tray with an outwardly oriented lip formed of impact resistant material and disposed on a portion of the side walls of the tray furthest from the bottom of the tray. The lip of the tray slides within an inwardly oriented C-shaped, impact resistant extension to engage the bottom of a glass or dish rack and thereby secure the tray to the glass or dish rack without any additional attaching means. Alternatively, the tray may have a groove disposed on the side walls of the tray and the glass or dish rack may have a C-shaped projection for engaging with the groove disposed in the side walls of the tray.

The invention described above can also be used to secure a wire dish rack to the debris holding tray.

For other objects and advantages of the invention, reference may be had to the following detailed description of the invention taken in connection with the accompanying drawings.

BRIEF DESCRIPTION OF THE DRAWINGS

FIG. 9 is a perspective view of a sixth embodiment of the present invention;

FIG. 10 is a top view of a seventh embodiment of the present invention;

FIG. 11 is an enlarged view of a portion of the seventh embodiment of the present invention;

FIG. 12 is a top view of an eighth embodiment of the present invention;

FIG. 13 is a cross-sectional view of the eighth embodiment of the present invention;

FIG. 14 is a cross-sectional view of a tenth embodiment of the present invention;

FIG. 15 is an enlarged perspective view of a portion of the eighth embodiment of the present invention;

FIG. 16 is a side view of a portion of the eighth embodiment of the present invention;

FIG. 17 is a perspective view of a portion of the seventh and eighth embodiments of the present invention;

FIG. 18 is a perspective view of a portion of the seventh and eighth embodiments of the present invention;

FIG. 19 is a perspective view of a ninth embodiment of the present invention; and FIG. 20 is a cross-sectional view of the ninth embodiment of the present invention.

DESCRIPTION OF THE PREFERRED EMBODIMENTS

Figure 1:
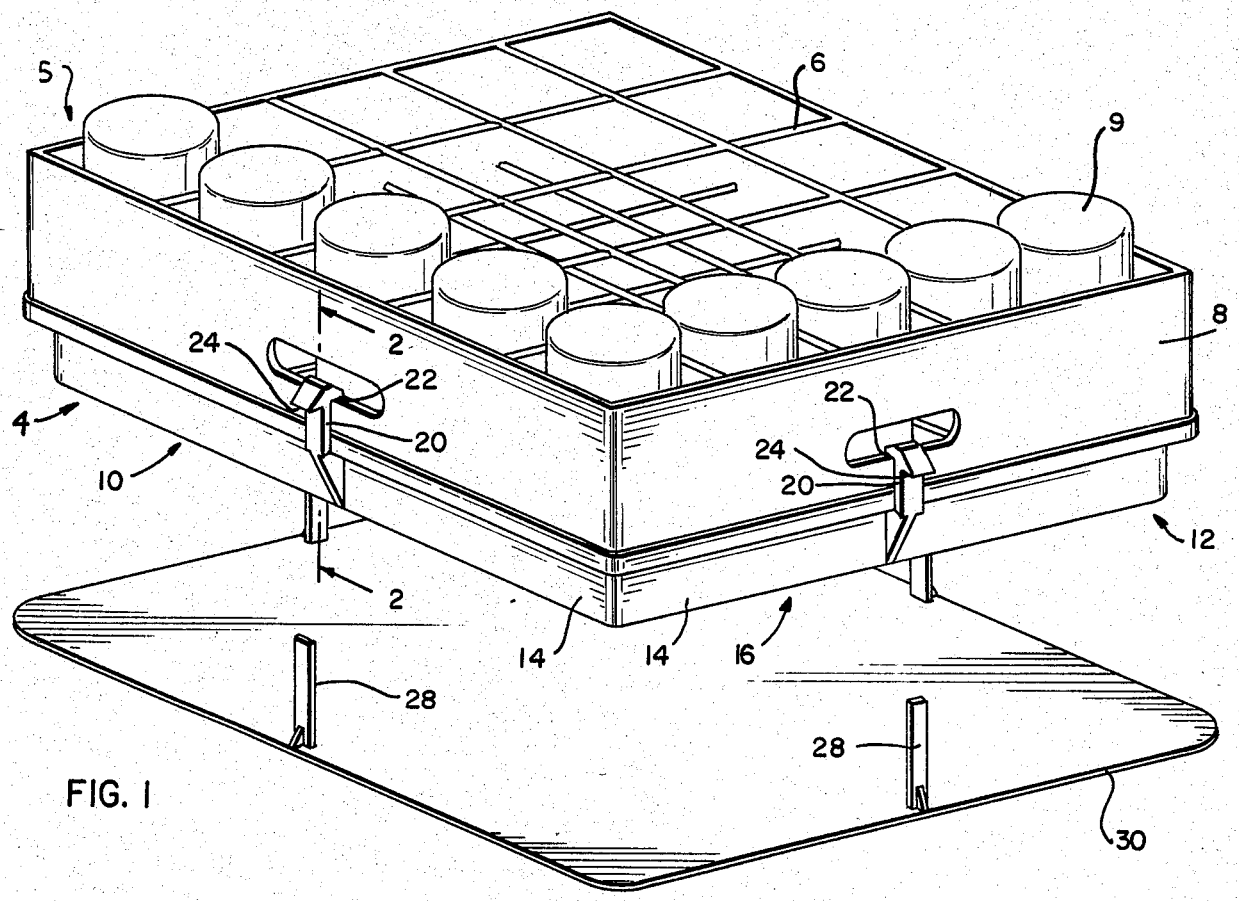
FIG. 1 is a perspective view of a first embodiment of the device for securing the debris holding tray to the glass or dish rack.

Referring now, in more detail, to the drawings wherein similar reference numerals identify corresponding parts throughout the several views, FIG. 1 illustrates an embodiment wherein a glass, dish, silverware or pot rack 4 of rubberized, impact resistant material that comprises a molded basket 5 of rectangular construction. In this figure, rack 4 is shown as a glass rack containing a plurality of spaced rubberized plastic strips 6 formed to create compartments for holding a plurality of glasses or cups 9. The rack 4 has side walls 8 and a bottom 10 (bottom 10 not shown in FIG. 1). The bottom 10 is constructed to allow waste water and debris from inverted glasses or cups 9 to flow out of the glasses or dishes through the rack 4 to the tray 12.

The debris holding tray 12 includes at least four substantially vertical sidewalls 14 and a bottom 16 (bottom 16 not shown in FIG. 1). Bottom 16 of the debris holding tray 12 can be ribbed or corrugated so as to prevent sloshing and wave motion by liquid debris contained in the tray during movement or transport of the tray (see FIG. 9). Alternatively, the bottom 16 of tray 12 can be smooth.

The debris holding tray 12 can be made of impact resistant, temperature resistant rubberized plastic or a similar durable material. A gasket 18 (shown in FIGS. 2 and 3) can be disposed between the debris holding tray 12 and the rack 4 to ensure a tight seal when the rack 4 is secured onto the tray 12 with any one of the embodiments of the attaching means.

Figure 2:
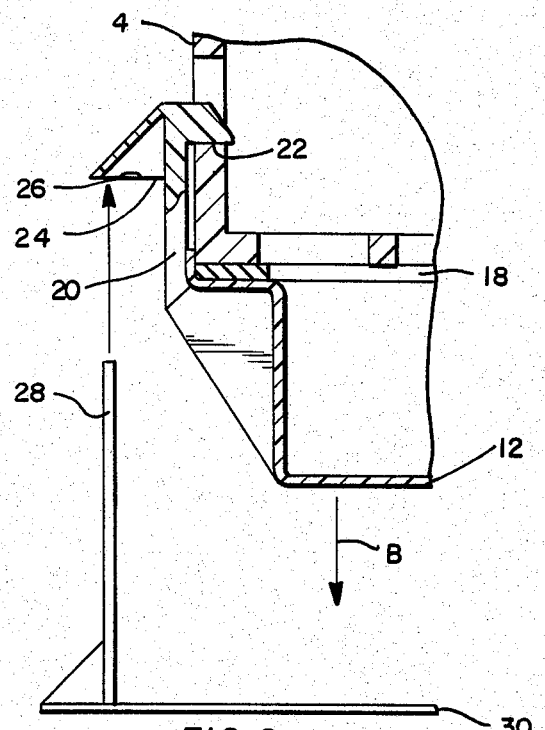
FIG. 2 is a cross-sectional view of the first embodiment of the invention in an engaged position.
Figure 3:
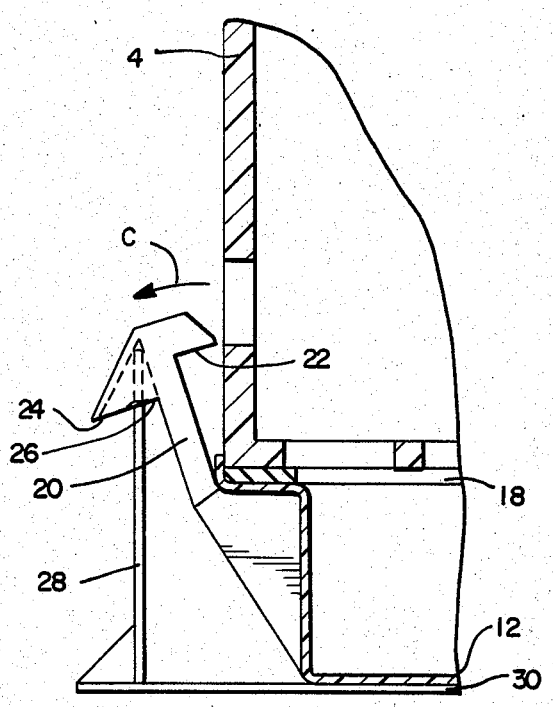
FIG. 3 is a cross-sectional view of the first embodiment of the invention in a disengaged position.

The attaching means, as shown in FIGS. 1, 2 and 3, comprises a resilient member 20 outwardly extending from the debris holding tray 12. This resilient member 20 can be integral with or alternatively non-integral with the debris holding tray. Also, the resilient member can be adjustable in length in order to accomodate any size glass or dish rack. This resilient member 20 can comprise a first latch face 22 for securing the tray 12 to rack 4. In another embodiment, the resilient member 20 can comprise a first latch face 22 and a second latch face 24. In a preferred embodiment, the first latch face 22 snugly fits over an edge of an aperture in a side wall of the rack 4. Alternatively, the first latch face may extend over the top edge of the rack 4.

A second latch face 24 can extend from resilient member 20 in a direction opposite the first latch face 22. The second latch face 24 can comprise an opening 26, for receiving a substantially vertical pole 28. The substantially vertical pole 28 can slide into opening 26 in latch face 24, when the tray is moved in the direction indicated by arrow B. Pole 28 engages with attaching means 20 and pulls attaching means 20 away from engagement with the rack 4, while the debris holding tray 12 is being pushed down against vertical pole 28. For complete disengagement of the resilient member 20 from the debris holding tray 12, the tray 12 should be resting on a frame 30 which supports the vertical pole 28. Frame 30 is not secured to either debris holding tray 12 or rack 4 but is an independent structure. The attaching means of this embodiment can be readily disengaged from the glass or dish rack 4 after the vertical pole 28 engages with the opening in the second latch face 24. The glass or dish rack 4 can then be lifted off the tray 12.

Figure 4:
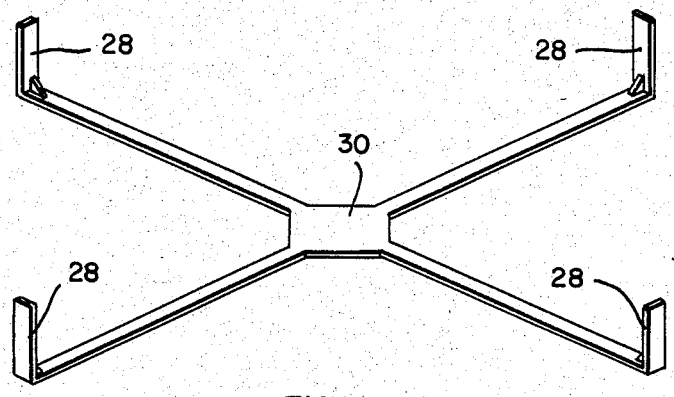
FIG. 4 is a perspective view of a part of the first embodiment of the invention.

FIG. 4 shows the frame portion of the above embodiment of the invention. Frame 30 has substantially vertical poles 28 disposed on portions of frame 30 that correspond to resilient members 20 on the tray 12.

Figure 5:
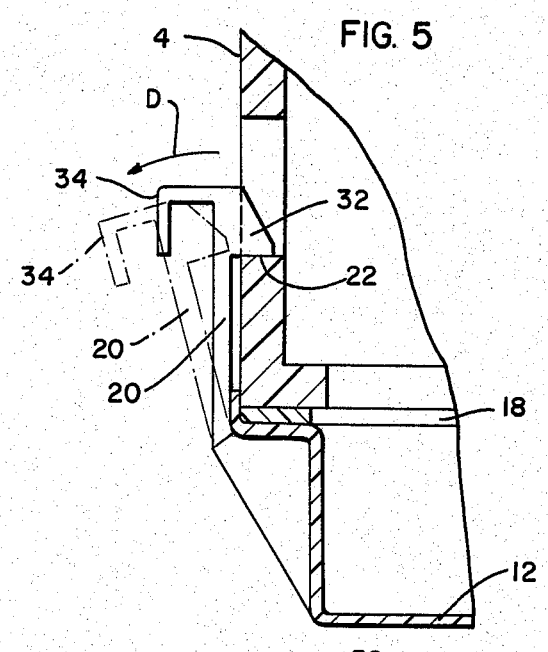
FIG. 5 is a cross-sectional view of a second embodiment of the invention.

FIG. 5 is a view of yet another embodiment of the present invention in cross-section. In this embodiment, a resilient member 20 has a projection or dog 32 disposed on a portion of the resilient member 20 furthest from the debris holding tray 12. Dog 32 can also have a first latch face 22 for engaging with the glass or dish rack 4 and a handle portion 34 secured to the portion of the dog 32 furthest from the debris holding tray 12. The handle 34 can disengage the first latch face 22 from glass or dish rack 4 if the handle 34 is pulled in the direction indicated by arrow D. The phantom representation of the dog 32 shows dog 32 pulled away from engagement with glass or dish rack 4. In an alternative embodiment, handle 34 can be used to carry tray 12 independent of the rack 4 or alternatively, with the rack 4 disposed on top of the tray 12.

Figure 6:
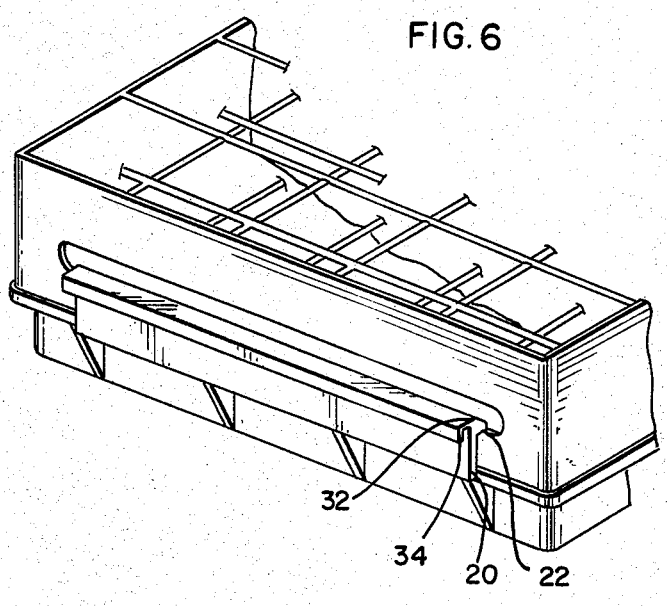
FIG. 6 is a cross-sectional view of a third embodiment of the instant invention.

FIG. 6 shows another embodiment of the present invention. In this embodiment, a resilient member 20 extends from debris holding tray 12. Resilient member 20 can extend partially or alternatively, substantially completely, along one side of glass or dish rack 4. Resilient member 20 has a projection or dog 32 with a handle portion 34 and a latch face 22 for securing snugly against the rack 4. In this embodiment, the handle portion 34 can be used to disengage latch face 22 from rack 4. Once the resilient member is disengaged from the rack, the rack 4 can be readily lifted from debris holding tray 12. Alternatively, the handle portion 32 can be used to carry the tray 12 with or without the rack disposed thereon.

Figure 7:
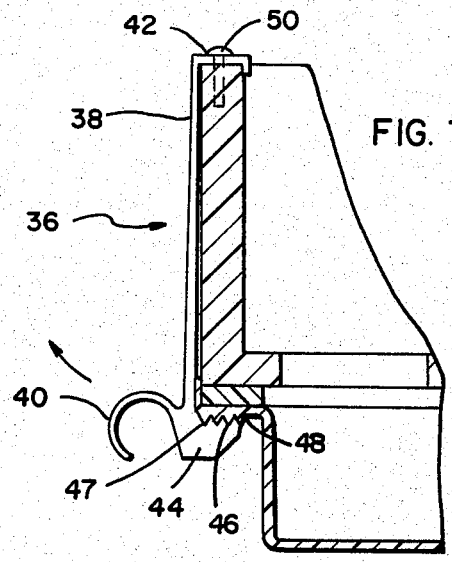
FIG. 7 is a cross-sectional view of a fourth embodiment of the instant invention.

FIG. 7 shows yet another embodiment of the present invention. In this embodiment, a clip 36 composed of substantially resilient material with a substantially C-shape, has a body portion 38, a handle portion 40, a top member 42 and a bottom member 44. The body member 44 has a latch face 46 with a corrugated or ribbed construction 47 for engaging with a corrugated or ribbed lip 48 of the debris holding tray 12. The corrugation or ribbing 47 allows clip 36 to fit snugly with the tray 12 so that the clip can not be easily pulled away from the tray 12 when accidently knocked or when deliberately held by handle portion 40. In addition to fastening the tray 12 to the rack 4, the device may be constructed to carry tray 12 with rack 4 disposed on top of tray 12 by using the handle portion 40 of the clip 36 as carrying means. Alternatively, handle portion 40 may be used only to disengage the clip 36. The corrugated or ribbed lip 48 of the debris holding tray 12 extends along the perimeter of the vertical side walls 14 of the debris holding tray 12. The top member 42 of the clip 36 can be removably secured to the top of the glass or dish rack 4 for instance, by a bolt assembly 50. In an alternative embodiment, the C-shaped clip 36 can be secured to a side portion of the rack 4. The clip 36 can be adjustable to securely engage different sized glass or dish racks 4.

Figure 8:
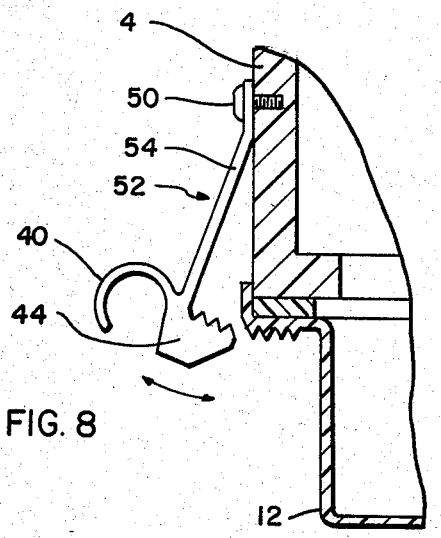
FIG. 8 is a cross-sectional view of a fifth embodiment of the instant invention.

FIG. 8 is still another embodiment of the present invention. In this embodiment, clip 52 is substantially L-shaped. Clip 52 comprises a bottom portion 44, a handle portion 40 and a side member 54 that may extend the full length of the glass or dish rack 4. Alternatively, side member 54 may extend only partially up the side of glass or dish rack 4. In this embodiment, the clip 52 can be placed at a variety of intervals around the glass or dish rack 4 or alternatively, at only a few positions around the rack 4 and can be used to both secure the glass or dish rack 4 to the debris holding tray 12 and carry the tray 12 when glass or dish rack 4 is disposed on top of the tray. Alternatively, clip 52 may be used to simply secure tray 12 to rack 4. Side member 54 of the L-shaped clip can be removably secured to glass or dish rack 4 by way of a bolt assembly 50.

FIG. 9 illustrates an embodiment of the present invention for securing a wire glass or wire dish rack 58 to a debris holding tray 12. In this embodiment, a C-shaped clip 56 has a top member 60 that can be removably secured to a top wire of the wire glass or wire dish rack 58 without additional securing means. The top member 60 comprises a hook 61 that can securely fasten to a top wire member of a wire glass or wire dish rack 58. Clip 56 has a side member 38 and a bottom member 44 with a handle 40. Clip 56 can fasten the rack 58 to tray 12 at any plurality of points on the corrugated or ribbed lip. Clip 56 can be non-adjustable to fit certain sizes of racks 4, or alternatively, adjustable to fit around any size glass or dish rack 4.

FIG. 10 is a top view of an embodiment of the present invention. In this embodiment, attaching means 62 are secured to corners 63 of the debris holding tray 12. Attaching means 62 can be brought up from the debris holding tray 12 and pulled around glass or dish rack 4, joining the two members. Attaching means 62 can be made from flat elastic bands, tubular elastic rope-like structures or alternatively, non-elastic straps. Attaching means 62 can alternatively be partially rigid in construction.

FIG. 11 is a enlarged perspective view of the attaching means 62. In this embodiment, the debris holding tray 12 has a projection 64 in each corner of the vertical side walls 14. The attaching means 62 can engage a projection 64 and then be pulled up and around the side walls of the tray 12 securing the glass or dish rack 4 to the tray 12. Attaching means 62 need not extend diagonally from corner to corner across the glass or dish rack 4, rather, attaching means 62 can extend upwardly from projection 64 to a corner portion of the glass or dish rack, at which point a clip can be provided to secure the attaching means to the corner portion.

FIG. 12 is a top view of another embodiment of the invention. In this view, a plurality of attaching means 62 are secured to the side walls 14 of the debris holding tray 12. The attaching means 62 can be pulled up and around the glass or dish rack 4 and fastened together at the top of the glass or dish rack 4 with, for instance, a serrated buckle 68. A plurality of attaching means and a plurality of fastening means, such as the serrated buckles, can be employed to fasten the glass or dish rack to the debris holding tray (as suggested with the phantom attaching means and buckles in FIG. 12).

FIG. 13 is enlarged view of an embodiment of the attaching means 62. In this embodiment, attaching means 62 are interlocking flexible elastic tubes 63 which have a flexible elastic fiber 65 disposed in the center of the elastic tube. The tube 63 can be made of a woven material, spun elastic yarn or a similar substances.

FIG. 15 is an enlarged top view of a means for securing together the attaching means 62 once the attaching means are pulled around the glass or dish rack. FIG. 15 illustrates a "come-along" 74. This "come-along" 74 comprises a handle 76 attached to a gear 78. The handle 76 and gear 78 assembly gear provide means for winding a first member attaching means 64 around a shaft 81 and a second member of attaching means 62 around a shaft 79. Handle 76 of the come-along 74 is rotatable in a direction so that the gear 78 engages a sprocket 80 and the sprocket 80 winds the attaching means 62 around the shaft 79.

FIG. 16 is a side view of the "come-along" 74 shown in FIG. 15. Handle 76 can be wound in the direction shown by the arrow A. For this "come-along", a first member 72 of the attaching means 62 is non-removably secured to a shaft 81. Alternatively, member 72 could be removably secured to shaft 81. A second member of attaching means 62, indicated as member 77, is removably secured to a second shaft 79. The come-along operates in a conventional manner.

FIG. 17 is an enlarged perspective view of a projection 84 engaged with the side wall 14 of the debris holding tray 12. Projection 84 serves to secure attaching means 62 to the debris holding tray 12. Projection 84 is surrounded on two sides by slots 83 and 85 so that attaching means 62 can be secured around projection 84 without contacting side wall 14 of the debris holding tray 12. The end of the attaching means 62 as shown in FIG. 17, can be folded over and riveted to itself around projection 84. A buckle arrangement, which permits extension of the attaching means, may be provided instead of the rivets or other fixed fastening devices.

FIG. 18 is an alternative embodiment of projection 64. In this embodiment, projection 64 is integral with and extending away from the side wall 14 of the debris holding tray 12. Attaching means 62 can be fastened around projection 64 prior to pulling the fastening means around the glass or dish rack 4. Attaching means 62 can have at one end, a hook-shaped construction 100, for engaging projection 64. Alternatively, projection 64 could have a snap mechanism for removably engaging attaching means 62 with projection 64. A similar projection can be provided on the glass or dish rack 4 so that hooks 100 on each end of the attaching means 62 can engage the projection 64.

FIG. 19 is a perspective view of another embodiment of the present invention. In this embodiment, a shaft 84 is disposed within a wall 14 of the debris holding tray 12. At one end of the shaft 84 is a knob 86. At the other end of shaft 84 is a securing member 88. The shaft 84 rotates along a longitudinal axis X—X'. Shaft 84 can contain a spring 87 (FIG. 20) for securely engaging the debris holding tray 12 to the rack 4. Securing member 88 can be constructed in a variety of sizes and shapes, for instance, securing member 88 can be semicircular in shape. Securing member 88 could also be triangular in shape. An elastic gasket 18 may be disposed between the wall of the tray 12 and the wall of the rack 4 as shown in FIG. 20. The gasket 18 can be disposed on the bottom of the tray 12 and substantially completely up a side wall portion of the tray 12.

FIG. 20 is a cross-sectional view of an embodiment of the instant invention wherein securing member 88 is engaged with the glass or dish rack 4. At a first position, shaft 84 engages securing member 88 with a wall portion of the glass or dish rack 4. At a second position, shaft 84 disengages securing member 88 from a wall portion of the glass or dish rack 4. The first position is diametrically opposed to the second position.

FIG. 14 is a cross-sectional view of still another embodiment of the present invention. In this embodiment, a glass or dish rack 4 is manufactured with a C-shaped extension 90 that extends around the perimeter of the glass or dish rack 4. This extension 90 extends from the lower portion of the glass or dish rack 4. Debris holding tray 12 is manufactured with an outwardly oriented lip extension 92 which can be engaged in the C-shaped extension 90 of the glass or dish rack 4. In an alternative embodiment, a gasket 94 can be inserted in the interior portion of the C-shaped extension 90 in order to insure a snug fit between the outwardly oriented lip extension 92 of debris holding tray 12 and C-shaped extension 90 of glass or dish rack 4. The lip 92 of the tray 12 can be disposed on four sides of the tray or alternatively on two or three sides of the tray 12.

Alternatively, rack 4 may have an extension projecting from a bottom portion of the rack which can engage with a groove disposed in a side wall of the tray 12. The groove in tray 12 may contain a gasket to insure a snug fit between the rack 4 and the tray 12.

Various changes and modifications may be made to the above described embodiments of the present invention without departing from the scope of the appended claims.

What is claimed is:

1. A tray device for carrying at least one article, said tray device comprising:

a rack for holding said at least one article;

a debris holding tray arranged beneath said rack, said debris holding tray adapted to contain debris dropping from said at least one article;

a device for releasably securing said debris holding tray to said rack, said device including a resilient member extending from said debris holding tray, said resilient member being disposed on a side wall of said debris holding tray;

said resilient member comprising a dog for engaging said rack; and said dog comprising a first latch face with means for engaging a side of said rack.

2. The device as claimed in claim 1, wherein said dog further comprises a second latch face with means for receiving a portion of a substantially vertical pole extending from a frame disposed beneath said rack.

3. A device as claimed in claim 2, wherein said second latch face is a handle for disengaging said first latch face from said tray.

4. A device as claimed in claim 2, wherein said substantially vertical pole is one of a plurality of substantially vertical poles secured to said frame.

5. A device as claimed in claim 1, wherein said tray comprises a ribbed bottom.

6. A device as claimed in claim 1, wherein the first latch face engages an edge of an aperture in a side of the rack.

7. A device as claimed in claim 1, wherein said rack is a rack for glasses and dishes for a dishwasher.

8. A tray device for carrying tableware such as dishes, silverware and glasses, said tray device comprising:

a dish rack for a dishwasher, said dish rack adapted to hold said tableware;

a debris holding tray arranged beneath said dish rack, said debris holding tray adapted to contain debris dropping from said tableware, said debris holding tray having side walls and a bottom wall that are made from temperature resistant impact resistant, rubberized material;

a detachable device for releasably securing said debris holding tray to said dish rack, said detachable device comprising:

a first resilient member extending from a first side wall of said debris holding tray;

a second resilient member extending from a second side wall of said debris holding tray; and said first resilient member being disposed substantially opposite said second resilient member;

said first and second resilient members each comprising a dog for engaging said dish rack;

said dog comprising a first latch face with means for engaging a side of said dish rack, and a handle portion; and said handle portion of said dog comprising means for disengaging said dog from said dish rack.

9. A device as claimed in claim 8, wherein said handle portion further comprises means for carrying said tray with said rack disposed over said tray.

10. A device as claimed in claim 8, wherein said bottom wall of said tray comprises a ribbed construction to prevent wave motion of liquid when contained in said tray.

11. A tray device for carrying at least one article, said tray device comprising:

a rack for holding said at least one article;

a debris holding tray arranged beneath said rack, said debris holding tray adapted to contain debris dropping from said at least one article;

a device for releasably securing said debris holding tray to said rack, said device including a clip of resilient material with a handle portion and a body portion; and said body portion further comprising a side member with means for securing said side member to said rack, and a bottom member comprising a latch face with means for fitting said latch face against an outwardly extending portion of said debris holding tray to secure said rack to said tray.

12. A device as claimed in claim 11, wherein said handle portion comprises means for carrying said tray with said rack disposed on top of said tray.

13. A device as claimed in claim 11, wherein a bottom portion of said tray has a ribbed construction.

14. A device as claimed in claim 11, wherein said rack is a wire dishwasher basket with dividers and corner posts, a plurality of wires extend between said corner posts to form side walls of said wire basket for retaining glasses and dishes within said basket.

15. A device as claimed in claim 11, wherein said body portion is L-shaped.

16. A device as claimed in claim 11, wherein said side member includes a top member, and said body portion is C-shaped.

17. A device as claimed in claim 16, wherein said means for securing said side member to said rack includes a latch face on said top member for releasably engaging an edge of a side wall of said rack.

18. A device as claimed in claim 16, wherein said means for securing said side member to said rack includes a bolt assembly extending through said top member.

19. A device as claimed in claim 11, wherein said means for securing said side member to said rack includes a bolt assembly extending into said side member.

20. A tray device for carrying at least one article, said tray device comprising:

a rack for holding said at least one article;

a debris holding tray arranged beneath said rack, said debris holding tray adapted to contain debris dropping from said at least one article;

a device for securing said debris holding tray to said rack, said device including a shaft disposed within an upper portion of a side wall of said debris holding tray;

a knob disposed at one end of said shaft; and a securing member disposed at the other end of said shaft rotatable about a longitudinal axis of said shaft and rotatable between a first position for engaging said securing member with said rack and a second position opposed to said first position for disengaging said securing member from said rack.

21. A device as claimed in claim 20, wherein a gasket extends between the side walls of the tray and the side walls and bottom of said rack to ensure a snug fit once said device secures said tray to said rack.

22. A device as claimed in claim 20, wherein said shaft is spring loaded.

* * * * *